US005974626A

United States Patent [19]

Wood et al.

[11] Patent Number: 5,974,626

[45] Date of Patent: Nov. 2, 1999

[54] COLLECTION SYSTEM FOR A FLOOR POLISHING MACHINE

[75] Inventors: David Wood, Maple Plain; William F. Allen, Wayzata, both of Minn.

[73] Assignee: Nilfisk-Advance, Inc., Plymouth, Minn.

[21] Appl. No.: 08/824,680

[22] Filed: Mar. 26, 1997

[51] Int. Cl.[6] ..... A47L 11/20

[52] U.S. Cl. ..... 15/385; 15/347; 55/361; 55/419

[58] Field of Search ..... 15/385, 347; 55/419, 55/361, 374

[56] References Cited

U.S. PATENT DOCUMENTS

| | | | |
|---|---|---|---|
| Re. 28,022 | 5/1974 | Lamont . | |
| D. 251,668 | 4/1979 | Asberg . | |
| 548,201 | 10/1895 | Hvass . | |
| 634,813 | 10/1899 | Gans . | |
| 928,456 | 7/1909 | Johnson . | |
| 935,558 | 9/1909 | Spangler . | |
| 1,093,820 | 4/1914 | Beach . | |
| 1,140,992 | 5/1915 | Martin | 15/347 |
| 1,433,021 | 10/1922 | Michael . | |
| 1,677,533 | 7/1928 | Staehle . | |
| 1,718,804 | 6/1929 | White . | |
| 1,763,365 | 12/1930 | Nobbs . | |
| 1,857,240 | 12/1932 | Dittmar . | |
| 1,891,175 | 12/1932 | Petersen . | |
| 2,045,980 | 6/1936 | Nagy . | |
| 2,250,177 | 7/1941 | Boccasile . | |
| 2,251,442 | 8/1941 | Emmons . | |
| 2,268,863 | 1/1942 | Emmons . | |

(List continued on next page.)

FOREIGN PATENT DOCUMENTS

| | | |
|---|---|---|
| 206309 | 10/1955 | Australia . |
| 225948 | 12/1957 | Australia . |
| 414936 | 8/1969 | Australia . |
| 723168 | 1/1932 | France . |
| 1144444 | 2/1963 | Germany . |

(List continued on next page.)

OTHER PUBLICATIONS

The Floorboss MkII, Manufactured by Air Cooled Industrial Engines Pty. Ltd. Australia (pre–1976).

Victor Floor Care, Registered in England No. 407289.

Progress Floor Maintenance Equipment, Progress Limited (pre–1976).

(List continued on next page.)

*Primary Examiner*—Chris K. Moore

*Attorney, Agent, or Firm*—Alan Kamrath; Oppenhezmer Wolff & Donnelly LLP

[57] ABSTRACT

A dust collection/control system is disclosed utilized in a floor polishing machine (10) in the most preferred form. A polishing member (16) for maintaining a floor surface as it is moved along the floor is located and rotated within a housing or shield (186) including a circular, planar portion (92) terminating at its periphery in a downwardly extending flange (94) including a flexible skirt (95) which engages the floor. The rotation of the polishing member (16) within the housing (186) passively generates an air current contained within the housing (186). The air current engages first and second air barriers (190, 191) which extend downwardly from the planar portion (92) and generally radially inwardly from the flange (94) to create high pressure areas upstream of the air barriers (190, 191) with high pressure air being allowed to escape through separate air outlets (188, 189) into a single filter and collection bag (148) and to create a vacuum inside of the housing (186) to draw air around the skirt (95) to entrain the dust and air in the circling air current. In the preferred form, the air barriers (190, 191) are circumferentially spaced at a angle in the order of 20° from each other and are sized so that the flow rates through the air outlets (188, 189) are generally equal.

19 Claims, 3 Drawing Sheets

U.S. PATENT DOCUMENTS

| | | | |
|---|---|---|---|
| 2,415,372 | 6/1947 | Salt et al. . | |
| 2,550,384 | 4/1951 | Senne | 55/419 X |
| 2,609,555 | 9/1952 | Anderson . | |
| 2,663,893 | 12/1953 | Percy . | |
| 2,668,976 | 5/1954 | Beach . | |
| 2,680,260 | 6/1954 | Danielsson et al. . | |
| 2,744,272 | 5/1956 | Theis et al. . | |
| 2,758,328 | 8/1956 | Fillery . | |
| 2,801,437 | 8/1957 | Okun . | |
| 2,910,818 | 11/1959 | Beal et al. . | |
| 2,933,752 | 4/1960 | McLennon . | |
| 2,946,080 | 7/1960 | Burch . | |
| 2,949,619 | 8/1960 | Holt . | |
| 2,956,546 | 10/1960 | Teters et al. . | |
| 2,957,295 | 10/1960 | Brown . | |
| 3,049,853 | 8/1962 | Horner et al. . | |
| 3,064,292 | 11/1962 | Fillery . | |
| 3,065,490 | 11/1962 | Arones . | |
| 3,118,267 | 1/1964 | Shaw . | |
| 3,135,985 | 6/1964 | Hulst . | |
| 3,148,397 | 9/1964 | Kuchar et al. . | |
| 3,157,009 | 11/1964 | Barkley . | |
| 3,157,015 | 11/1964 | Russell et al. . | |
| 3,195,985 | 7/1965 | Elkin . | |
| 3,226,759 | 1/1966 | Worwag . | |
| 3,264,674 | 8/1966 | Doyle, Jr. et al. . | |
| 3,314,099 | 4/1967 | Otto . | |
| 3,375,540 | 4/1968 | Hyde . | |
| 3,413,783 | 12/1968 | Gordon . | |
| 3,417,420 | 12/1968 | Rock . | |
| 3,453,812 | 7/1969 | Heidner et al. . | |
| 3,522,679 | 8/1970 | Sunberg . | |
| 3,531,819 | 10/1970 | Lamont . | |
| 3,568,421 | 3/1971 | Smith et al. . | |
| 3,597,903 | 8/1971 | Schaaf | 55/419 X |
| 3,619,849 | 11/1971 | Jones . | |
| 3,619,954 | 11/1971 | Miller . | |
| 3,678,532 | 7/1972 | Boyd . | |
| 3,719,966 | 3/1973 | Lamont . | |
| 3,824,745 | 7/1974 | Hutchins . | |
| 3,974,598 | 8/1976 | Guidry . | |
| 4,052,950 | 10/1977 | Hirata . | |
| 4,116,648 | 9/1978 | Busch . | |
| 4,148,110 | 4/1979 | Moen . | |
| 4,178,654 | 12/1979 | Mitchell . | |
| 4,274,847 | 6/1981 | Crener . | |
| 4,307,480 | 12/1981 | Fallen . | |
| 4,322,866 | 4/1982 | Brazzale . | |
| 4,358,868 | 11/1982 | Cook, Jr. . | |
| 4,365,377 | 12/1982 | Todd et al. . | |
| 4,381,628 | 5/1983 | Dicke . | |
| 4,549,371 | 10/1985 | Hakoda . | |
| 4,598,440 | 7/1986 | Wilson . | |
| 4,624,078 | 11/1986 | Van Rijen et al. . | |
| 4,631,775 | 12/1986 | Palmer et al. . | |
| 4,638,523 | 1/1987 | Todd . | |
| 4,701,976 | 10/1987 | Palmer et al. . | |
| 4,715,087 | 12/1987 | Todd et al. . | |
| 4,720,886 | 1/1988 | McLeod et al. . | |
| 4,731,895 | 3/1988 | Zack et al. . | |
| 4,731,956 | 3/1988 | Wood . | |
| 4,765,099 | 8/1988 | Tanner . | |
| 4,805,258 | 2/1989 | Sitarskietal . | |
| 4,930,264 | 6/1990 | Huang . | |
| 4,939,811 | 7/1990 | Matunaga et al. | 15/385 |
| 5,027,470 | 7/1991 | Takashima | 15/385 |
| 5,064,455 | 11/1991 | Lackner . | |
| 5,088,151 | 2/1992 | Legatt . | |
| 5,388,305 | 2/1995 | Fields | 15/385 |
| 5,392,492 | 2/1995 | Fassauer | 15/385 X |
| 5,464,460 | 11/1995 | Bosses . | |
| 5,500,978 | 3/1996 | Levine | 15/347 |

FOREIGN PATENT DOCUMENTS

| | | |
|---|---|---|
| 1239448 | 11/1967 | Germany . |
| 1728286 | 9/1968 | Germany . |
| 3928494 | of 1963 | Japan . |
| 3822687 | 10/1963 | Japan . |
| 4631813 | 11/1971 | Japan . |
| 289811 | 9/1928 | United Kingdom . |
| 470192 | 8/1937 | United Kingdom . |
| 486499 | 6/1938 | United Kingdom . |
| 772855 | 4/1957 | United Kingdom . |
| 826255 | 12/1959 | United Kingdom . |
| 889397 | 2/1962 | United Kingdom . |
| 949158 | 2/1964 | United Kingdom . |
| 1310314 | 3/1973 | United Kingdom . |

OTHER PUBLICATIONS

Fans by Theodore Baumeister, Jr. First Edition, McGraw–Hill Book Company, Inc. New York and London, 1935.

Centrifugal and Axial Flow Pumps, Theory Design, and Appln. copyright 1957 by John Wiley and Sons, Inc.

Centrifugal and Other Rotodynamic Pumps, Herbert Addison, Third Edition, London Chapman & Hall 1966.

The Way Things Work, An Illustrated Encyclopedia of Technology Simon and Schuster, New York copyright 1967.

Reckitt & Colman Cleaning Systems, Vinco Polivac Model PV25MKII, Oct. 1981.

Hako®Minuteman® Manual 986711 dated Feb. 1988 (p8–9,back/front).

Hako®Minuteman® Advertisement 986712 copyright 1987.

COLLECTION SYSTEM FOR A FLOOR POLISHING MACHINE

BACKGROUND

The present invention relates to apparatus for cleaning, particularly to apparatus for cleaning floor surfaces, and specifically to a unique and novel dust collection system for a floor polishing machine.

High speed burnishing is a floor polishing method using a very fine abrasive disc rotating at 1000 RPM's or more to produce a high "wet look" glass appearance on the floor. Typically a high solids content floor finish material is spread in a thin layer on the floor, allowed to harden, and then burnished with a high RPM burnishing machine. The burnishing process removes the top particles of the floor finish with the fine abrasive rotating disc, producing a smooth glossy appearance. In the process, the top layer of floor finish is removed in the form of a very fine powder. In addition to this powder, the burnishing pad itself wears down. This powder and worn pad material often become airborne because of the air turbulence created by the high speed rotation of the disc. This is undesirable because the powder, material and dust then settle back onto the floor and on furniture and must be removed with a dust mop, vacuum cleaner or similar means.

To reduce the need to dust mop after burnishing or polishing, prior floor polishing means included dust collection systems of various forms. Some prior dust collection systems utilized a separate vacuum device including a fan for creating a vacuum to pick up dirt or dust such as in U.S. Pat. Nos. 2,663,893 and 3,522,679. Further, many prior dust collection systems utilized the well known cyclone effect created by the rotation of the operative member inside of a housing to deliver air entrained with dirt, dust, and other debris and created by the rotation of the operative member relative to a working surface such as shown in floor maintenance devices such as in U.S. Pat. No. 1,093,820; in shoe cleaning apparatus such as in U.S. Pat. No. 2,933,752; in lawn mowers such as in U.S. Pat. No. 3,413,783; in abrading tools such as in U.S. Pat. No. 4,148,110, and the like. For example, U.S. Pat. No. 3,064,292 shows a fan attached to the drive shaft for the polishing or other floor-maintenance element for drawing dust-laden air from adjacent the floor and discharging it through a dust-collection bag. Similarly, U.S. Pat. No. 4,178,654 shows a fan which is rotated at a higher rotational speed than the polishing brush. U.S. Pat. No. 4,598,440 shows an X-pad for creating air currents and which eliminates the need for a fan. U.S. Pat. No. 4,731,956 shows an impeller integrally formed on the hub portion of the polishing member.

However, each of these collection systems is deficient in various respects in ease of manufacture and assembly, effective collection, economies, operation, and the like. For example, such collection systems interfere with the ability of the housing to deform to follow the floor surface as is utilized in many current types of floor burnishing machines and in the effective collection of dust and debris, especially around the entire periphery of the floor polishing or other maintenance element.

U.S. Pat. No. 5,088,151 represented a major advancement in the art of collection systems for floor polishing machines. However, deficiencies arose as two separate filter and collection bags were utilized. This was disadvantageous because normal maintenance required removal and replacement of such filter and collection bags at multiple locations rather than a single location and enclosing such filter and collection bags at multiple locations such as for aesthetic reasons was costly and constructionally complicated.

Thus a need continues for a floor polishing machine which provides dust and debris control and which overcomes the deficiencies and disadvantages of prior collection systems.

SUMMARY

The present invention solves these and other needs and problems in the field of collection systems by providing, in the preferred form, dual, circumferentially adjacent but spaced air barriers formed in the housing and extending toward the member for maintaining the floor surface which rotates creating high pressure areas rotationally upstream from the air barriers, which direct air streams to pass through air outlets into a filter device, and which create a vacuum for drawing air between the housing and the work surface and into the air current created by the rotation of the floor surface maintenance member.

In preferred aspects of the present invention, a device is provided for filtering and collecting dust simultaneously from first and second, separate, air streams and including separate provisions for receiving the respective air stream into the closed interior of a bag formed of filter material. Thus, in the most preferred form, the air streams of the air outlets of the dual air barriers are simultaneously directed into a single vacuum filter bag.

It is thus an object of the present invention to provide a novel dust collection/control system.

It is further an object of the present invention to provide such a novel dust collection/control system without requiring specially manufactured polishing pads and the like.

It is further an object of the present invention to provide such a novel dust collection/control system utilizing a vacuum chamber located concentric with the rotating working member.

It is further an object of the present invention to provide such a novel dust collection/control system utilizing air currents passively generated by the rotating working member.

It is further an object of the present invention to provide such a novel dust collection/control system which allows the housing to follow the floor surface regardless of the unevenness of the floor surface and/or wear of the floor engaging skirt.

It is further an object of the present invention to provide such a novel dust collection/control system utilizing plural collection points but at circumferentially adjacent but spaced positions.

It is further an object of the present invention to provide such a novel dust collection/control system which can be easily and inexpensively incorporated into a floor polishing machine.

It is further an object of the present invention to provide such a novel dust collection/control system providing a novel device for filtering and collecting dust simultaneously from first and second, separate, air streams.

It is further an object of the present invention to provide such a novel dust collection/control system producing air streams at circumferentially adjacent locations having generally equal flow rates.

It is further an object of the present invention to provide such a novel dust collection/control system utilizing plural air barriers of differing sizes.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
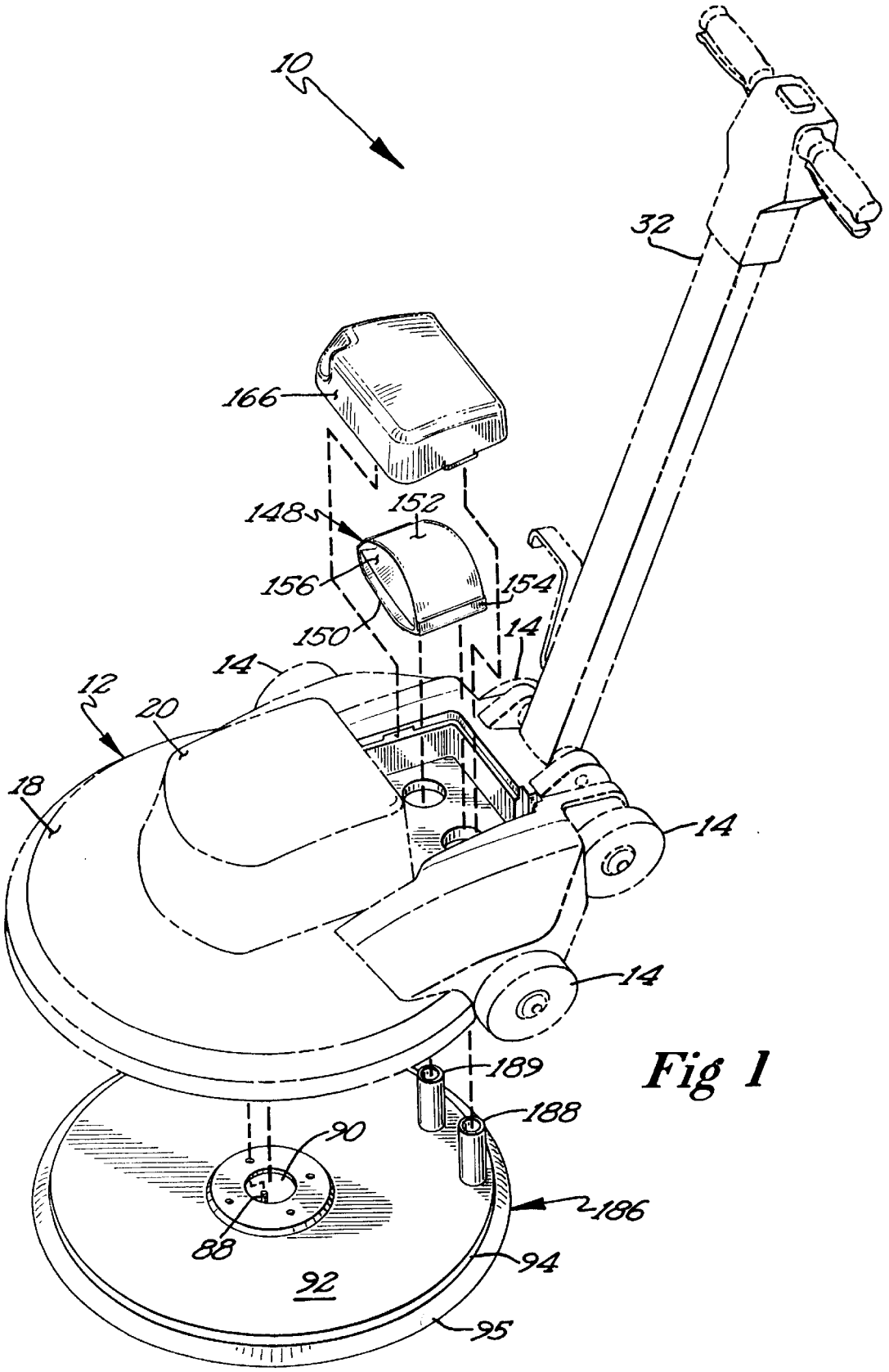
FIG. 1 shows an exploded, top perspective view of a floor polishing machine including a dust collection/control system according to the preferred teachings of the present invention, with portions shown in phantom.
Figure 2:
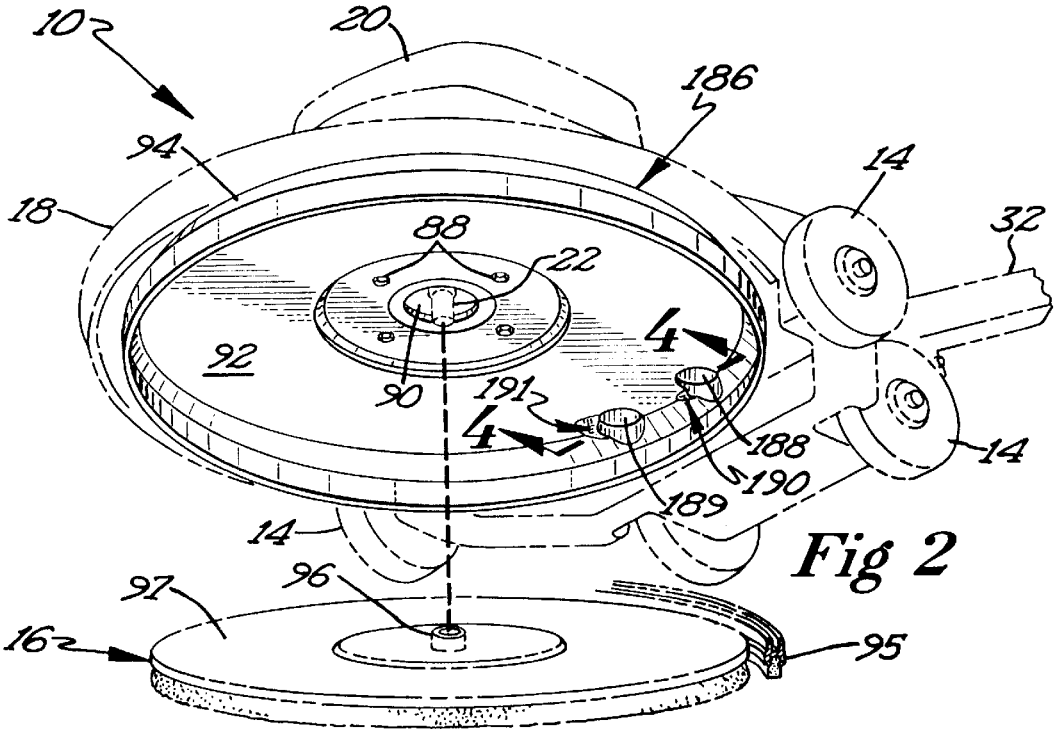
FIG. 2 shows a partial, exploded, bottom perspective view of the floor polishing machine of FIG. 1, with portions shown in phantom.
Figure 3:
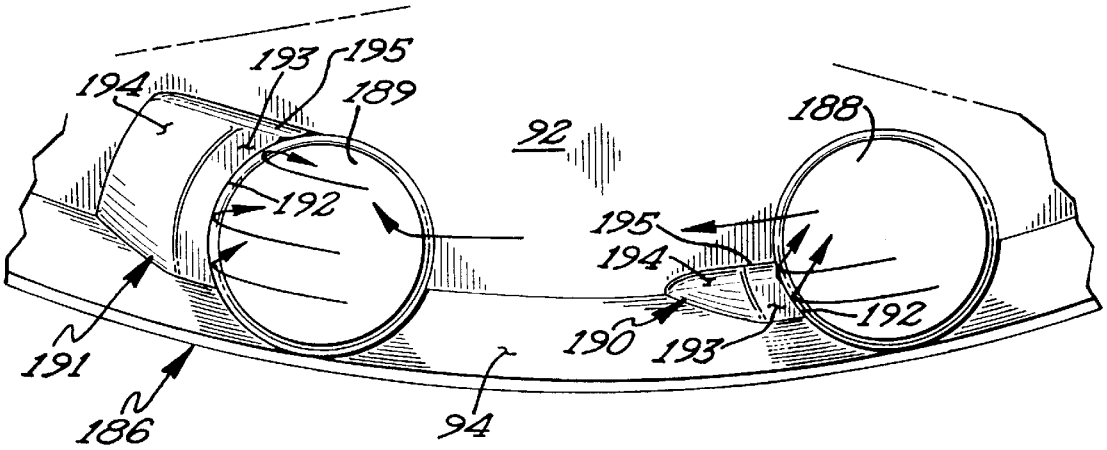
FIG. 3 shows a partial, bottom view of the floor polishing machine of FIG. 1.
Figure 4:
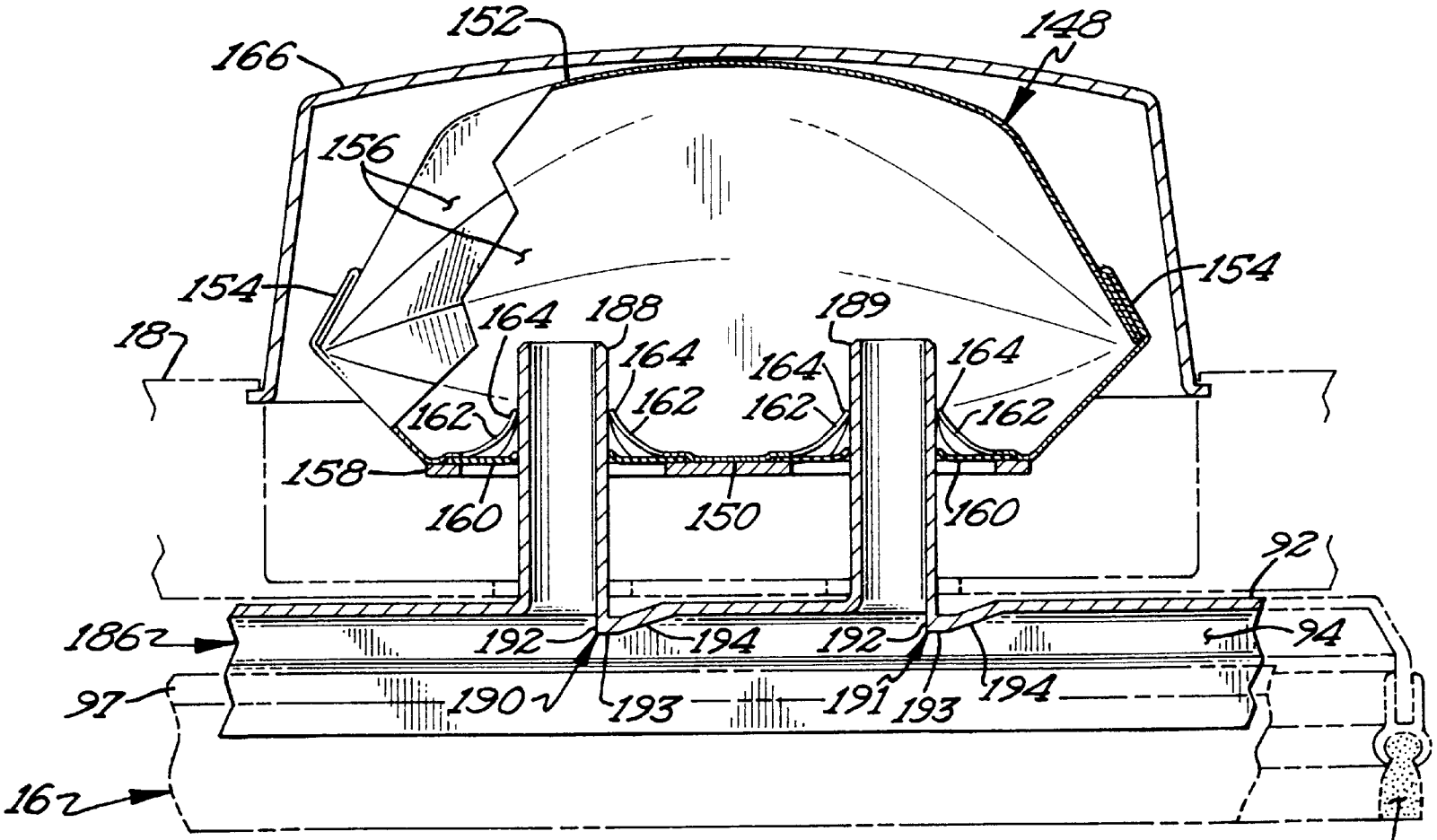
FIG. 4 shows a partial, cross-sectional view of the floor polishing machine of FIG. 1 according to section line 4—4 of FIG. 2.

All figures are drawn for ease of explanation of the basic teachings of the preferred embodiment only; the extensions of the Figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "top", "bottom", "upper", "lower", "first", "second", "front", "rear", "end", "edge", "forward", "inside", "outside", and similar terms are used herein, it should be understood that these terms have reference only to the structure shown in the drawings as it would appear to a person viewing the drawings and are utilized only to facilitate describing the preferred embodiment.

DESCRIPTION

A machine for maintaining a work surface is shown in the drawings in its most preferred form as a floor polishing machine according to the preferred teachings of the present invention and is generally designated 10. Floor polishing machine 10 generally includes a chassis or body portion 12 adapted to be moved along a floor or other cleaning surface such as by wheels 14. A planar polishing member 16 for polishing the floor surface when rotated about a polishing axis extending generally perpendicular to the floor and in a plane substantially parallel to the floor surface when body portion 12 is moved along the floor is provided in its most preferred form as a holder of the flexible type for a polishing pad, brush or the like. Body portion 12 includes an enlarged circular, downwardly curving base section 18 and a top section 20 enclosing a motor having a vertically orientated output shaft 22 which forms the polishing axis and to which polishing member 16 is non-rotatably secured. Base section 18 surrounds the upper portion of polishing member 16. Polishing member 16 according to the teachings of the present invention includes a hub portion 96 for slideable receipt of shaft 22 of the motor enclosed within top section 20 and an annular disc 97 of flexible construction and forming the backing for polishing pad, brush, or the like of polishing member 16. Hub portion 96 and polishing member 16 are rotatably related to shaft 22 of the motor by any suitable means.

Floor polishing machine 10 further includes suitable apparatus for raising polishing member 16 relative to the floor to allow transporting machine 10 from one location to another in a non-operating mode and for lowering polishing member 16 relative to the floor to allow engagement of polishing member 16 in an operating mode. Further, floor polishing machine 10 can include provisions for allowing the placement of even cleaning pressure on the floor surface by polishing member 16 regardless of the unevenness of the floor surface. It can be realized that the raising and lowering of polishing member 16 may be performed manually or automatically. In the most preferred form, polishing member 16 is raised and lowered manually by a handle 32 pivotally mounted to body portion 12 as shown, such as but not limited to the construction shown and disclosed in U.S. application control Ser. No. 08/723,785, now U.S. Pat. No. 5,674,120, issued Oct. 7, 1997, which is hereby incorporated herein by reference. However, floor polishing machine 10 could include the parallelogram and lift lever assembly such as shown and described in U.S. Pat. No. 4,731,956, which is hereby incorporated herein by reference.

Floor polishing machine 10 according to the teachings of the present invention includes provisions for creating a vacuum chamber surrounding polishing member 16 and located around and concentrically to floor polishing member 16. Specifically, a housing or shield 186 is provided secured to the platform mounting the motor enclosed within top section 20 by bolts 88 with shaft 22 of the motor extending through central opening 90. Specifically, shield 186 is closed for air flow there-through and includes a generally planar portion 92 of a circular configuration in its most preferred form located on the opposite side of polishing member 16 from the floor surface. Shield 186 further includes a flange 94 extending downwardly from the periphery of planar portion 92 towards and adjacent to the floor surface and having a size complementary to but larger than polishing member 16. Flange 94 includes a flexible skirt 95 dependingly mounted therefrom. Skirt 95 is formed of a felt material and has openings cut therein to allow air to enter shield 186 around the entire periphery and/or may be formed of filter media allowing air flow therethrough. In the most preferred form, shield 186 is made from thin plastic or like material so that shield 186 can flex to follow uneven floors and adjust for skirt wear, all the while pressing skirt 95 against the floor.

First and second vertical, circumferentially spaced air outlets or spouts 188 and 189 upstand from planar portion 92 adjacent to flange 94 of shield 186 and generally parallel to the polishing axis. In the preferred form, spouts 188 and 189 are cylindrical having circular cross sections of equal diameters and include portions which are contiguous with flange 94. Just downstream from spouts 188 and 189, first and second elongated air barriers or dams 190 and 191 are formed in the bottom face of planar portion 92. In the most preferred form, air dams 190 and 191 are formed by depressions in planar portion 92. Specifically, air dams 190 and 191 each include a first, vertically extending face 192 integrally extending generally perpendicularly from the bottom face of planar portion 92 towards but spaced from polishing member 16 and having an opposite edge. Air dams 190 and 191 further include a second face 193 integrally extending downstream generally perpendicular to face 193 and parallel to and spaced from the bottom face of planar portion 92. Air dams 190 and 191 further include a third face 194 integrally extending angularly between the opposite edge of face 193 and the bottom face of planar portion 92 spaced downstream from face 192. In the preferred form, face 194 extends at an angle in the order of 45° from the bottom face of planar portion 92 and of face 193. The vertical spacing of faces 193 of dams 190 and 191 from planar portion 92 are equal in the most preferred form. Air dams 190 and 191 terminate in inner sides 195 integrally extending generally perpendicular from the bottom face of planar portion 92 and from faces 192, 193, and 194. The edges of faces 192, 193, and 194 opposite sides 195 integrally terminate in flange 94. Air dams 190 and 191 extend from flange 94 generally radially towards the polishing axis of polishing member 16. Additionally, air dams 190 and 191 extend from flange 94 to a point spaced from the diametric center and specifically, at a location spaced from shaft 22 and hub portion 96. Air dams 190 and 191 (and spouts 188 and 189) are circumferentially spaced from each other but are circumferentially adjacent at a relatively small acute angle relative to the axis of rotation of annular disc 97 of polishing member 16 and specifically at an angle in the order of 20° from each other relative to the axis of rotation of annular disc 97 of polishing member 16. In the form shown, dam 191 is located after dam 190 in the direction of rotation of annular disc 97 of polishing member 16. According to the teachings of the present invention, dams 190 and 191 are constructed so that the air streams passing through outlets 188 and 189 have generally equal flow rates. In the preferred form, dam 190 has a size which is smaller than the size of dam 191. Specifically, air dam 190 extends from flange 94 to a point or an extent which is generally one-half the radial extent of spout 188 from flange 94. However, air dam 191 extends from flange 94 to a point or an extent which is greater than the radial extent of dam 190 and which is generally equal the radial extent of spout 189 from flange 94. In the preferred form, side 195 of dam 190 extends generally radially from spout 188, and side 195 of dam 191 extends generally tangentially from spout 189 and at an angle in the order of 70° to a radius of planar portion 92 and of polishing member 16. Faces 192 of dams 190 and 191 in the preferred form are arcuate in shape and in the most preferred form are concentric to spouts 188 and 189, with the free end of face 192 of dam 190 at side 195 located upstream from the end of face 192 of dam 190 at flange 94.

In the preferred form, a single dust collection and filter device 148 such as a vacuum filter bag as shown is removably attached to and in fluid communication with both spouts 188 and 189 for simultaneously receiving the separate air streams flowing therefrom. Bag 148 includes a closed interior and is formed of filter material allowing the escape of pressurized air from the closed interior while generally preventing dust from passing from the closed interior to the outside of bag 148. In a preferred form, bag 148 is shown including a bottom wall 150, a top wall 152, first and second ends 154, and side walls 156. In the most preferred form, side walls 156 include gussets or pleats that enable bag 148 to be flat with bottom and top walls 150 and 152 being closely adjacent to each other during shipping and storage and to enable bag 148 to expand with bottom and top walls 150 and 152 being spaced from each other when pressurized air is introduced into the interior thereof. In the form shown, ends 154 are formed by folding walls 150, 152, and 156 about a laterally extending fold line, with the folded portions being suitably adhered or otherwise secured together. It should be appreciated that walls 150, 152, and 156 and ends 154 can be of any other desired shape, size, and construction including but not limited to those of conventional dust collection and filter bags utilized in vacuum cleaners and the like.

Bag 148 further includes a cardboard stiffener 158 secured to the lower surface of bottom wall 150 and outside its closed interior, with stiffener 158 having an area slightly smaller than the area of bottom wall 150 in the preferred form. Stiffener 158 includes first and second apertures or openings of a size and location for receipt around first and second spouts 188 and 189, respectively. First and second yieldable annular gaskets 160 are secured intermediate stiffener 158 and wall 150 of bag 148 and include apertures of a size for slideable, sealable receipt of spouts 188 and 189 respectively and providing a removable sealing relationship between spouts 188 and 189 and bag 148. Bottom wall 150 includes first and second openings of a size and location for receipt on spouts 188 and 189 and inside of the apertures of gaskets 160 and defined by slits 162 extending radially outward from the centers of each of the apertures formed in gaskets 160 and defining isosceles triangle spaced flaps 164. Thus, when spouts 188 and 189 are extended through the apertures of gaskets 160 and the openings of the stiffener 158, spouts 188 and 189 are able to deflect flaps 164 outwardly to allow insertion of spouts 188 and 189 into the interior of bag 148 such that the free ends of spouts 188 and 189 are located in the closed interior of bag 148 so that the air streams passing through spouts 188 and 189 are separately and simultaneously received into the closed interior of bag 148.

In the most preferred form, body portion 12 includes a removable cover 166 positioned intermediate top section and the pivots for handle 22 for enclosing bag 148 when spouts 188 and 189 are inserted therein. It should be appreciated that cover 166 or its interconnection with the other components of body portion 12 must have suitable provisions for allowing the escape of air while minimizing the release of noise.

Now that the basic construction of floor polishing machine 10 according to the preferred teachings of the present invention has been explained, the operation and subtle features of the dust collection system of machine can be set forth and appreciated. Specifically, as polishing member 16 rotates, which in the preferred form is in a counterclockwise rotation from the top while standing in front of machine 10 facing handle 32 and at 2000 RPM, polishing member 16 passively generates an air current moving in the same direction as the rotation of polishing member 16 and adjacent flange 94. This air current is contained inside the vacuum chamber in the space between the outside diameter of polishing member 16 and flange 94 and skirt 95 and in the space between the top of polishing member 16 and planar portion 92 of shield 186. It should be noted that polishing member 16 in the preferred form does not include an impeller, fan, or other means for actively generating such air currents as in prior polishing machines.

It can then be appreciated that as the passively generated air current comes to air dam 190, a portion of the generated air current impacts face 192 of dam 190 and thus a region of pressure higher than atmospheric pressure or in other words a high pressure area is created due to the decreased area between the opposite edge of face 192 and polishing member 16 than between planar portion 92 and polishing member 16 upstream of air dam 190. The high pressure air seeks to escape so it readily flows out spout 188 into bag 148, carrying with it any dust and containments. However, the air current which is radially spaced from flange 94 at a greater distance than side 195 or which flows around side 195 and which is vertically spaced below planar portion 92 greater than face 193 or which flows below face 193 flows past dam 190. The generated air current then comes to air dam 191 and impacts face 192 thereof. Again, a region of pressure higher than atmospheric pressure is created upstream of dam 191, with the high pressure air seeking to escape so it readily flows out spout 189 into bag 148, carrying with it any dust and contaminants.

It should be noted that air dam 190 has a size and specifically has a reduced radial extent in comparison to dam 191 such that air flow exists through both spouts 188 and 189 even though they are circumferentially adjacent each other, with the air flow rates through spouts 188 and 189 being generally equal.

It should be appreciated that as air passes through spouts 188 and 189, it is replaced by air drawn in through the openings in, under, or through skirt 95 as regions of pressure lower than atmospheric pressure are created in shield 186 due to generation of air currents and the air passage through spouts 188 and 189. Surprisingly, even though air dams 190 and 191 are circumferentially adjacent each other, air is drawn generally around the entire 360° circumference of shield 186 and specifically the tendency of any air to escape from the interior of shield 186, under, through, or through openings in skirt 95 is minimized or even eliminated.

It should be appreciated that as air moves in shield 186 to adjacent flange 94, air is drawn from the center of polishing member 16 creating a low pressure zone at the center having a pressure lower than the air pressure adjacent flange 94. Also, the air pressure of the air current falls with increased radial spacing from flange 94. Air dams 190 and 191 have a radial extent relatively close to flange 94 and in the most preferred form have a radial extent which is generally no greater than the radial extent of spouts 188 and 189 and which is considerably shorter than the dams as taught in U.S. Pat. No. 5,088,151. Specifically, the radial extent of dams 190 and 191 is less than the radial extent of the air current from flange 94 so that air current passes circumferentially around sides 195 of dams 190 and 191. Thus, the tendency of air flow radially inward along face 192 towards the center of shield 186 and at the low pressure zone thereof, which could occur with the dams of U.S. Pat. No. 4,088,151, is eliminated.

It is noted that the problem of dirt and dust being blown away from rotating members is well known and is especially undesirable in cleaning apparatus where the air born dust settles back onto the cleaning surface or its environment where further effort is required for removal. Prior approaches have been utilized in prior cleaning and like apparatus to solve this problem; however, it is believed that a totally unique technique to solving this problem is accomplished by the present invention and is believed to be particularly advantageous. First, the present invention allows utilization of a standard circular polishing pad and the like and specifically does not require specially manufactured working members, polishing pads or the like. Further, due to the rotation of polishing member 16, powder created by the cleaning of the floor surface by polishing member 16 tends to move outwardly to the perimeter of polishing member 16. It should then be noted that the vacuum chamber located concentrically of polishing member 16 is particularly advantageous as the polishing member 16 tends to deliver such floor powder to the vacuum chamber for expulsion under pressure through spouts 188 and 189 created by air dams 190 and 191. Furthermore according to the teachings of the present invention, the degree of vacuum in the vacuum chamber may be easily varied by adjusting openings in skirt 95.

According to the preferred teachings of the present invention, first and second air dams 190 and 191 and spouts 188 and 189 are provided circumferentially spaced from each other to thus provide multiple collection points around the periphery rather than a single collection point. It has been found that multiple collection points dramatically increase the amount of material collected and specifically in the order of four times more. It should be noted that the vacuum created in any particular polishing means is a function of air speed within the shield, the size of air dams 190 and 191, and the diameter of spouts 188 and 189. Major factors for air speed are the rotational speed and size of polishing member 16 and the manner of generation of the air stream such as passively or by the active generation such as by the use of fans. Especially for passive systems or systems with generation means rotating at the same speed as the polishing member, the vacuum produced may be insufficient in single collection point systems to produce an indraft around the entire periphery and in fact in some portions of the periphery, air may even be pushed outwardly through the skirt. Multiple collection points as in the present invention allow the creation of multiple vacuum locations and specifically no single collection point is responsible for producing indrafts of air around the entire periphery as in prior single collection point systems. Furthermore, the indraft of air is more uniform with multiple collection points than with single point systems where the indraft of air decreases with the circumferential spacing from the collection point. Thus, the efficiency of the dust collection system is enhanced, as each collection point can collect dust more effectively over the portion of the periphery than over the entire periphery.

It can then be appreciated that the particular configuration of air dam 191 is believed to be particularly advantageous. Specifically, the angular relationship of air dam 191 to the radial direction biases the air current towards the periphery and spout 189. Further, the decreasing zone in cross-sectional area between flange 94 and air dam 191 as the air travels toward spout 189 biases the flow of air out of shield 186 through spout 189. Furthermore, the perpendicular arrangement of faces 192 to planar portion 92, polishing member 16, and the air currents passively generated thereby, maximizes the height of faces 192 in the air stream to create the pressure differential required for operation as well as creates a surface against which dust and other containments move. Furthermore, faces 193 and 194 allow dams 190 and 191 to be easily manufactured by molding.

Also, air dams 190 and 191 according to the preferred teachings of the present invention are also advantageous in allowing shield 186 to flex. Particularly, in the most preferred form, shield 186 can be formed of thin plastic and is flexible to allow shield 186 to deform to contact skirt 95 with the floor around its entire circumference as skirt 95 wears or if the floor surface is uneven, and to press skirt 95 against the floor. Prior to the present invention, one way of enhancing the creation of the air current is through the use of a containment housing for the polishing or floor-maintenance element with an increasing volume up to the collection point such as by a channel which enlarges along the periphery of the housing. Specifically, U.S. Pat. No. 1,093,820 shows an eccentrically disposed boss of a circular casing creating a channel extending around substantially all of the periphery and open to the interior of the housing and of a gradually increasing thickness to provide a gradually larger zone in cross-sectional area, with the air discharge nozzle in communication with the channel at its point of greatest cross-sectional area. The major disadvantage of the channel arranged outside of the periphery of the polishing or floor-maintenance element is the increased lateral sizing of the housing. To overcome this disadvantage, others have arranged the channel on the upper part of the housing such as in U.S. Pat. No. 4,178,654 as was well known in collection systems such as in lawn mowers as shown in U.S. Pat. Nos. 2,957,295; 3,049,853; 3,157,015; 3,413,783; 3,453,812; and 3,568,421 which similarly have a rotating maintenance element located in a housing which directs air and containments arising from the rotation of the maintenance element into a filter bag. It can then be recognized that the use of channels extending on the upper part and around a major portion of the periphery of the housing would be particularly disadvantageous in the use of flexible shields. Specifically, the bends required to form such channels would give shields further structural strength which adversely affect their ability to deform to engage the skirt with the floor surface. Thus, such channels would destroy the flexibility required for such shields to deform as the skirt wears or if the floor surface is uneven.

Air dams 190 and 191 according to the teachings of the present invention do not negatively impact on the flexibility of shield 186. Specifically, the bends forming faces 192, 193, and 194 of air dams 190 and 191 are generally arranged radially on planar portion 92, are spaced radially outward from the center of planar portion 92, and have a minimal radial extent from flange 94. Thus, although the bends forming air dams 190 and 191 do increase the structural strength of planar portion 92 at those locations, this increased structural strength does not prevent planar portion 92 from flexing from side-to-side generally about an axes defined by air dams 190 and 191, from flexing upwardly or downwardly radially inward of air dams 190 and 191 and specifically between sides 195 of air dams 190 and 191 and the central portion, and/or from deforming at locations intermediate air dams 190 and 191. It can then be appreciated that air dams 190 and 191 do not adversely affect the flexibility of shield 186 as would occur if an upper channel extending a major portion of the periphery of the housing of the type of U.S. Pat. No. 4,178,654 were utilized or would occur even if an upper chute extending substantially less than one-half of the periphery of the housing of the type of U.S. Pat. No. 4,731,956 were utilized and do not increase the lateral sizing of the housing as would occur if an eccentrically disposed channel such as U.S. Pat. No. 1,093,820 were utilized.

Bag 148 according to the preferred teachings of the present invention is advantageous as it includes first and second provisions for simultaneously receiving first and second, separate air streams from spouts 188 and 189 in the most preferred form. Thus, even though machine 10 has multiple collection points, an operator is only required to remove and replace a single bag 148 of a comparable size to that required for a single collection point rather separate bags 148 at each collection point. Thus, machine 10 is more maintenance labor friendly. Additionally, as only a single bag 148 is utilized, machine 10 can be easily designed to include cover 166 or the like to enclose bag 148 so that it can not be seen by the operator and bystanders and to prevent bag 148 from catching an obstruction around the work surface. Thus, even though machine 10 has multiple collection points, machine 10 including a single bag 148 according to the preferred teachings of the present invention is advantageous for aesthetic and operational reasons without detrimentally increasing the cost and complication of its manufacture and assembly.

Now that the basic teachings of the present invention have been explained, many extensions and variations will be obvious to one having ordinary skill in the art. For example, although in the preferred embodiment according to the teachings of the present invention the utility of the dust collection/control system has been illustrated in connection with a floor polishing machine, it can be appreciated that the system of the present invention has application in other fields where collection/control of debris is desired.

Further, although floor polishing member 16 is shown as being rotated by a motor powered by outlet current, polishing member 16 may be rotated by other means including a battery powered motor or by an internal combustion engine.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

We claim:

1. In a machine for maintaining a work surface including a planar member for rotation about an axis generally perpendicular to the work surface in a plane substantially parallel to the work surface and a housing including a planar portion located on the opposite side of the planar member from the work surface and having a periphery, with the housing further including a flange extending from the periphery of the planar portion towards and adjacent to the work surface, with the planar member located within the planar portion and flange of the housing, an improved system comprising, in combination: first and second air barriers extending from the planar portion of the housing towards but spaced from the planar member, with the air barriers being circumferentially spaced from each other and extending from the periphery of the planar portion towards the axis of the planar member; and an air outlet associated with each air barrier and extending from the housing adjacent the periphery of the planar portion and the air barrier, with the air outlet positioned on the side of the air barrier opposite to the direction of rotation of the planar member, with the air barriers being circumferentially adjacent at a relatively small acute angle from each other relative to the axis of the rotation of the planar member.

2. The system of claim 1 wherein the second air barrier is located after the first air barrier in the direction of rotation of the planar member, with the size of the first air barrier being smaller than the size of the second air barrier.

3. The system of claim 2 wherein the radial extent of the first air barrier is less than the radial extent of the second air barrier.

4. The system of claim 3 wherein each of the air barriers include a first face extending generally perpendicular to the work surface, with the first face having a configuration concentric to the air outlet.

5. The system of claim 4 wherein the air outlet is cylindrical in shape having circular cross sections.

6. The system of claim 1 wherein the air barriers are at an angle in the order of 20° from each other relative to the axis of the rotation of the planar member.

7. The system of claim 1 wherein the air stream through the air outlets associated with the first and second air barriers have generally equal flow rates.

8. The system of claim 1 wherein each of the air barriers include a first face extending generally perpendicular to the work surface, with the first face having a configuration concentric to the air outlet.

9. The system of claim 1 wherein the air barriers have a radial extent relatively close to the periphery of the planar portion.

10. The system of claim 9 wherein the radial extent of the air barriers from the periphery of the planar portion does not exceed the radial extent of the air outlet from the periphery of the planar portion.

11. The system of claim 1 wherein the air outlets extend in a direction parallel to the axis of the planar member.

12. The system of claim 1 wherein the air barriers are integrally formed with the planar portion.

13. The system of claim 1 wherein the planar portion is flexible to allow the housing to deform engaging the flange with the work surface.

14. The system of claim 2 wherein the first and second air barriers have an equal axial extent from the planar portion.

15. The system of claim 1 further comprising, in combination: device for filtering and collecting dust simultaneously from first and second, separate air streams flowing through the air outlets of the first and second air barriers comprising, in combination: a bag including a closed interior, with the bag being formed of filter material allowing the escape of pressurized air from the closed interior while generally preventing dust from passing from the closed interior to outside the bag; first means for receiving the first air stream into the closed interior of the bag; and second means for receiving the second air stream into the closed interior of the bag, with the second receiving means being separate from the first receiving means, with the closed interior simultaneously receiving the first and second air streams.

16. The system of claim 15 wherein each of the air outlet have a free end; and wherein the bag includes a bottom, with the receiving means each comprising, in combination: means for allowing-the spout to be passed through the bottom of the bag in a sealing relation with the bag and with the free end located in the closed interior of the bag.

17. Device for filtering and collecting dust simultaneously from first and second, separate air streams comprising, in combination: a bag including a closed interior, with the bag being formed of filter material allowing the escape of pressurized air from the closed interior while generally preventing dust from passing from the closed interior to outside the bag; first means for receiving the first air stream into the closed interior of the bag; and second means for receiving the second air stream into the closed interior the bag, with the second receiving means being separate from the first receiving means, with the closed interior simultaneously receiving the first and second air streams; wherein the first and second air streams pass through first and second spouts, respectively, with each of the spouts having a free end; and wherein the bag includes a bottom, with the receiving means each comprising, in combination: means for allowing the spout to be passed through the bottom of the bag in a sealing relation with the bag and with the free end located in the closed interior of the bag.

18. The device of claim 17 wherein the allowing means each comprise, in combination: an annular gasket secured to the bottom of the bag and including an aperture of a size for slidable, sealable receipt on the spout, with the bottom of the bag including an orifice inside of the aperture of the annular gasket allowing the spout to be passed therethrough.

19. The device of claim 18 further comprising, in combination: a stiffener secured to the bottom of the bag outside of the closed interior, with the stiffener including first and second openings of a size and location for receipt around the first and second spouts, with the gaskets secured intermediate the stiffener and the bottom of the bag.

* * * * *

UNITED STATES PATENT AND TRADEMARK OFFICE

CERTIFICATE OF CORRECTION

PATENT NO : 5,974,626

DATED : November 2, 1999

INVENTOR(S) : David Wood, et al.

It is certified that error appears in the above-identified patent and that said Letters Patent is hereby corrected as shown below:

Col. 4, line 16, cancel "control".

Col. 5, line 8, before "Air" start a new paragraph.

Col. 6, line 26, after "section" insert --20--.

Col. 6, line 36, after "machine" insert --10--.

Col. 11, line 32, cancel "-the spout" and substitute therefor --the air outlet--.

Signed and Sealed this

Eleventh Day of July, 2000

*Attest:*

Q. TODD DICKINSON

*Attesting Officer*

*Director of Patents and Trademarks*